US010227983B2

(12) United States Patent
Lee et al.

(10) Patent No.: US 10,227,983 B2
(45) Date of Patent: Mar. 12, 2019

(54) SCROLL COMPRESSOR HAVING AN OIL SEPARATION SPACE

(71) Applicant: LG ELECTRONICS INC., Seoul (KR)

(72) Inventors: Jaeha Lee, Seoul (KR); Junchul Oh, Seoul (KR); Seheon Choi, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 63 days.

(21) Appl. No.: 15/244,543

(22) Filed: Aug. 23, 2016

(65) Prior Publication Data

US 2017/0067467 A1 Mar. 9, 2017

(30) Foreign Application Priority Data

Sep. 9, 2015 (KR) ..... 10-2015-0127829

(51) Int. Cl.
*F04C 29/02* (2006.01)
*F04C 18/02* (2006.01)
(Continued)

(52) U.S. Cl.
CPC ..... *F04C 29/026* (2013.01); *F04C 18/0215* (2013.01); *F04C 23/008* (2013.01);
(Continued)

(58) Field of Classification Search
CPC .. F04C 29/026; F04C 18/0215; F04C 23/008; F04C 29/005; F04C 29/12
(Continued)

(56) References Cited

U.S. PATENT DOCUMENTS 5,125,810 A * 6/1992 Suefuji ..... F01C 17/066 418/179
5,197,868 A 3/1993 Caillat et al.
(Continued)

FOREIGN PATENT DOCUMENTS

CN 1749568 3/2006
CN 102812251 12/2012
(Continued)

OTHER PUBLICATIONS

English translation JP07189940 by Espacenet Jan. 8, 2018.*
(Continued)

*Primary Examiner* — Mary A Davis
*Assistant Examiner* — Deming Wan
(74) *Attorney, Agent, or Firm* — KED & Associates LLP

(57) ABSTRACT

A scroll compressor is provided that may include a casing; a drive motor; a fixed scroll that forms a compression space by being coupled to the orbiting scroll; and a discharge cover provided at an inner space of the casing, the discharge cover having a space that communicates with the compression space and separated from the inner space of the casing, and having one or more discharge hole on a side surface thereof, the one or more discharge hole providing communication between an inside and an outside of the space. With such a configuration, vibration noise of the scroll compressor may be more reduced in comparison with a case in which an oil separator is provided outside of the casing. Further, as an area of the one or more discharge hole and a volume of the space are optimized, efficiency of the scroll compressor may be enhanced.

14 Claims, 8 Drawing Sheets

(51) Int. Cl.

| | |
|---|---|
| ***F04C 23/00*** | (2006.01) |
| ***F04C 29/12*** | (2006.01) |
| ***F04C 29/00*** | (2006.01) |

(52) U.S. Cl.
CPC ..... *F04C 29/005* (2013.01); *F04C 29/0085* (2013.01); *F04C 29/12* (2013.01); *F04C 2210/206* (2013.01); *F04C 2210/26* (2013.01); *F04C 2240/10* (2013.01); *F04C 2240/20* (2013.01); *F04C 2240/30* (2013.01); *F05C 2201/021* (2013.01)

(58) Field of Classification Search
USPC ..... 418/55.1–55.6
See application file for complete search history.

(56) References Cited

U.S. PATENT DOCUMENTS

| | | | | |
|---|---|---|---|---|
| 6,082,981 | A * | 7/2000 | Nakajima | B01D 17/044 418/55.6 |
| 6,309,198 | B1 * | 10/2001 | Zamudio | F04C 29/021 418/55.6 |
| 7,862,313 | B2 * | 1/2011 | Hwang | F04C 18/0215 418/55.1 |
| 2004/0107847 | A1 | 6/2004 | Makino et al. | |
| 2007/0140884 | A1 | 6/2007 | Kim et al. | |
| 2008/0170957 | A1 | 7/2008 | Hwang et al. | |
| 2010/0209278 | A1 * | 8/2010 | Tarao | F01C 21/02 418/55.3 |
| 2013/0039792 | A1 * | 2/2013 | Hiratsuka | F04B 39/04 418/55.6 |

FOREIGN PATENT DOCUMENTS

| | | | | |
|---|---|---|---|---|
| EP | 2 236 828 | | 10/2010 | |
| JP | 07189940 | A * | 7/1995 | F04C 18/02 |
| JP | H 07-189940 | | 7/1995 | |
| JP | 2005-180295 | | 7/2005 | |
| JP | 2007-023985 | | 2/2007 | |
| JP | 2008-267141 | | 11/2008 | |
| JP | 2010-001816 | | 1/2010 | |
| KR | 2006-0024200 | | 3/2006 | |
| WO | WO 03/042543 | | 5/2003 | |

OTHER PUBLICATIONS

Korean Notice of Allowance dated Nov. 9, 2016 issued in Application No. 10-2015-0127829.
European Search Report dated Feb. 6, 2017 issued in Application No. 16186212.3.
Korean Office Action dated Aug. 31, 2016 issued in Application No. 10-2015-0127829.
Chinese Office Action dated Jan. 22, 2018. (English translation).
Chinese Office Action dated Aug. 30, 2018 with English Translation.

* cited by examiner

SCROLL COMPRESSOR HAVING AN OIL SEPARATION SPACE

CROSS-REFERENCE TO RELATED APPLICATION(S)

Pursuant to 35 U.S.C. § 119(a), this application claims priority to Korean Application No. 10-2015-0127829, filed in Korea on Sep. 9, 2015, the contents of which is incorporated by reference herein in its entirety.

BACKGROUND

1. Field

A scroll compressor is disclosed herein.

2. Background

A scroll compressor is a compressor that forms a pair of compression spaces having a suction chamber, an intermediate pressure chamber, and a discharge chamber between a fixed wrap of a fixed scroll and an orbiting wrap of an orbiting scroll, in a structure in which the fixed scroll is fixed to an inner space of a casing and the orbiting scroll performs an orbital motion by being engaged with the fixed scroll. The scroll compressor is being widely applied to air conditioners, for example, as a refrigerant compressor device, owing to its advantages that a compression ratio is higher than other types of compressors, and a stable torque is obtainable as processes to suction, compress, and discharge a refrigerant are performed smoothly. Recently, a scroll compressor of high efficiency, which has a driving speed of more than 180 Hz by lowering an eccentric load has been developed.

The scroll compressor of high efficiency generates a large centrifugal force as a rotational shaft rotates at a high speed. In this case, a large amount of oil may be discharged to the outside of the scroll compressor.

Considering this, a technique for preventing excessive discharge of oil has been disclosed. According to the technique, an oil separator is installed at one side of the casing of the compressor, thereby separating oil from a refrigerant to be discharged and collecting the separated oil in the casing before the oil flows to a refrigerating cycle.

FIG. 1 is a longitudinal sectional view illustrating an example of a high pressure type scroll compressor having an oil separator outside of a casing in accordance with the conventional art (hereinafter, referred to as a "scroll compressor"). As shown, in the conventional scroll compressor, a drive motor 20 that generates a rotational force is installed at an inner space 11 of a hermetic casing 10. A main frame 30 is installed above the drive motor 20.

A fixed scroll 40 is fixedly-installed on an upper surface of the main frame 30, and an orbiting scroll 50 is installed between the main frame 30 and the fixed scroll 40 so as to perform an orbital motion. The orbiting scroll 50 is coupled to a rotational shaft 60 coupled to a rotor 22 of the drive motor 20.

The orbiting scroll 50 has an orbiting wrap 52 which forms a pair of compression spaces (P) which move consecutively, by being engaged with a fixed wrap 43 of the fixed scroll 40. In the compression spaces (P), a suction chamber, an intermediate pressure chamber, and a discharge chamber are formed consecutively. In the intermediate pressure chamber, compression is consecutively executed step by step.

An Oldham's ring 70 configured to restrict a rotation of the orbiting scroll 50 is installed between the fixed scroll 40 and the orbiting scroll 50. A suction pipe 15 is penetratingly-coupled to an upper end of the casing 10, and a discharge pipe 16 is penetratingly-coupled to a side surface of the casing 10. The suction pipe 15 is coupled to an inlet 44 of the fixed scroll 40, thereby directly communicating with the suction chamber. The discharge pipe 16 is coupled to an oil separator 90 provided outside of the casing 10.

The oil separator 90 is formed to have a rectangular cylindrical shape, like the casing 10. The discharge pipe 16 is coupled to an upper-half part or portion of the oil separator 90, and an oil collecting pipe 91 configured to collect separated oil in the casing 10 is formed at a lower end of the oil separator 90. A refrigerant pipe 92 configured to guide an oil-removed refrigerant to a refrigerating cycle by being connected to the refrigerating cycle is coupled to an upper end of the oil separator 90.

An unexplained reference numeral 21 denotes a stator, 41 denotes a plate portion or plate of the fixed scroll, 42 denotes a side wall portion or side wall of the fixed scroll, 45 denotes an outlet, 51 denotes a plate portion or plate of the orbiting scroll, 53 denotes a boss portion or boss, 61 denotes an oil passage, 62 denotes a boss insertion groove, 65 denotes a balance weight, and 80 denotes a sub frame.

In the conventional scroll compressor, once a rotational force is generated as power is supplied to the drive motor 20, the rotational shaft 60 transmits the rotational force of the drive motor 20 to the orbiting scroll 50. Then, the orbiting scroll 50 performs an orbital motion with respect to the fixed scroll 40 by the Oldham's ring 70, and forms the pair of compression spaces (P) between the fixed scroll 40 and itself, thereby suctioning, compressing, and discharging a refrigerant.

The refrigerant discharged from the compression spaces (P) is discharged through the discharge pipe 16 via the inner space 11 of the casing 10. The refrigerant discharged through the discharge pipe 16 passes through the oil separator 90 before it moves to the refrigerating cycle. The refrigerant from which oil is separated by the oil separator 90 moves to a condenser of the refrigerating cycle through the refrigerant pipe 92. On the other hand, the oil separated from the refrigerant is collected to or in the inner space 11 of the casing 10 or an oil pump inside of the casing 10, through the oil collecting pipe 91. Such a process is performed repeatedly.

However, the conventional scroll compressor may have the following problems.

First, as the oil separator 90 is installed outside of the compressor, the scroll compressor including the oil separator 90 has an increased size, and vibration noise of the compressor is increased. Further, a space occupied by the scroll compressor in an outdoor unit or device is increased. This may cause the outdoor unit to have a size increase, or a spatial utilization degree may be lowered.

Considering this, the oil separator may be installed in the casing of the scroll compressor. However, in this case, as a driving speed of the scroll compressor is increased to 190 Hz from 160 Hz, a large amount of oil may be discharged together with a refrigerant. In order to solve such a problem, a volume of the oil separator should be increased. However, if the oil separator has an increased volume, a length of the scroll compressor in a shaftwise direction is increased. This may cause a space occupied by the scroll compressor to be increased, and may increase vibration noise of the scroll compressor.

BRIEF DESCRIPTION OF THE DRAWINGS

Embodiments will be described in detail with reference to the following drawings in which like reference numerals refer to like elements, and wherein.

DETAILED DESCRIPTION

Figure 1:
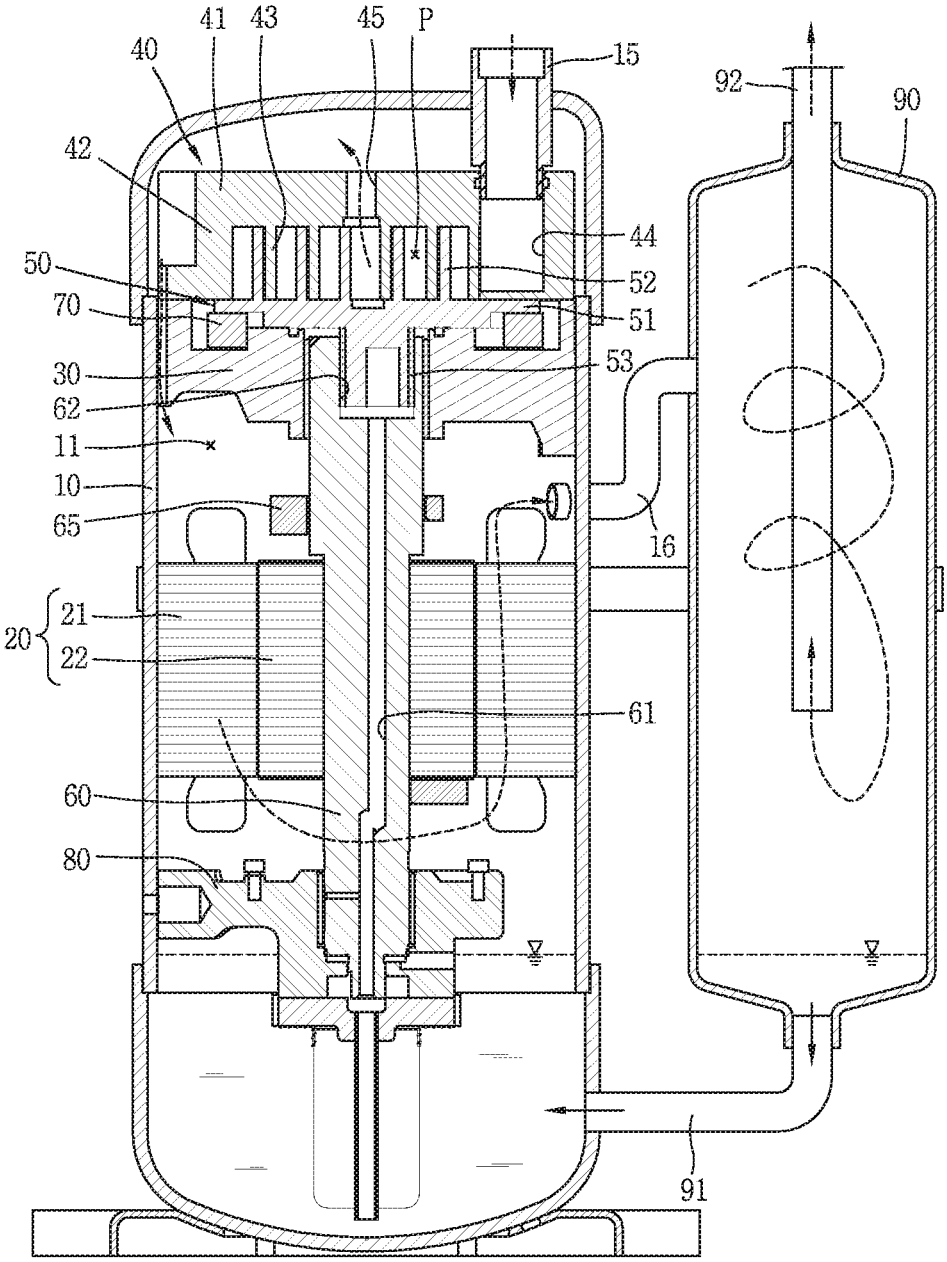
FIG. 1 CONVENTIONAL ART
FIG. 1 is a longitudinal sectional view illustrating an example of a scroll compressor in accordance with the conventional art.

Description will now be given in detail of embodiments of a scroll compressor, with reference to the accompanying drawings. Where possible, like reference numerals have been used to indicate like elements, and repetitive disclosure has been omitted.

Figure 2:
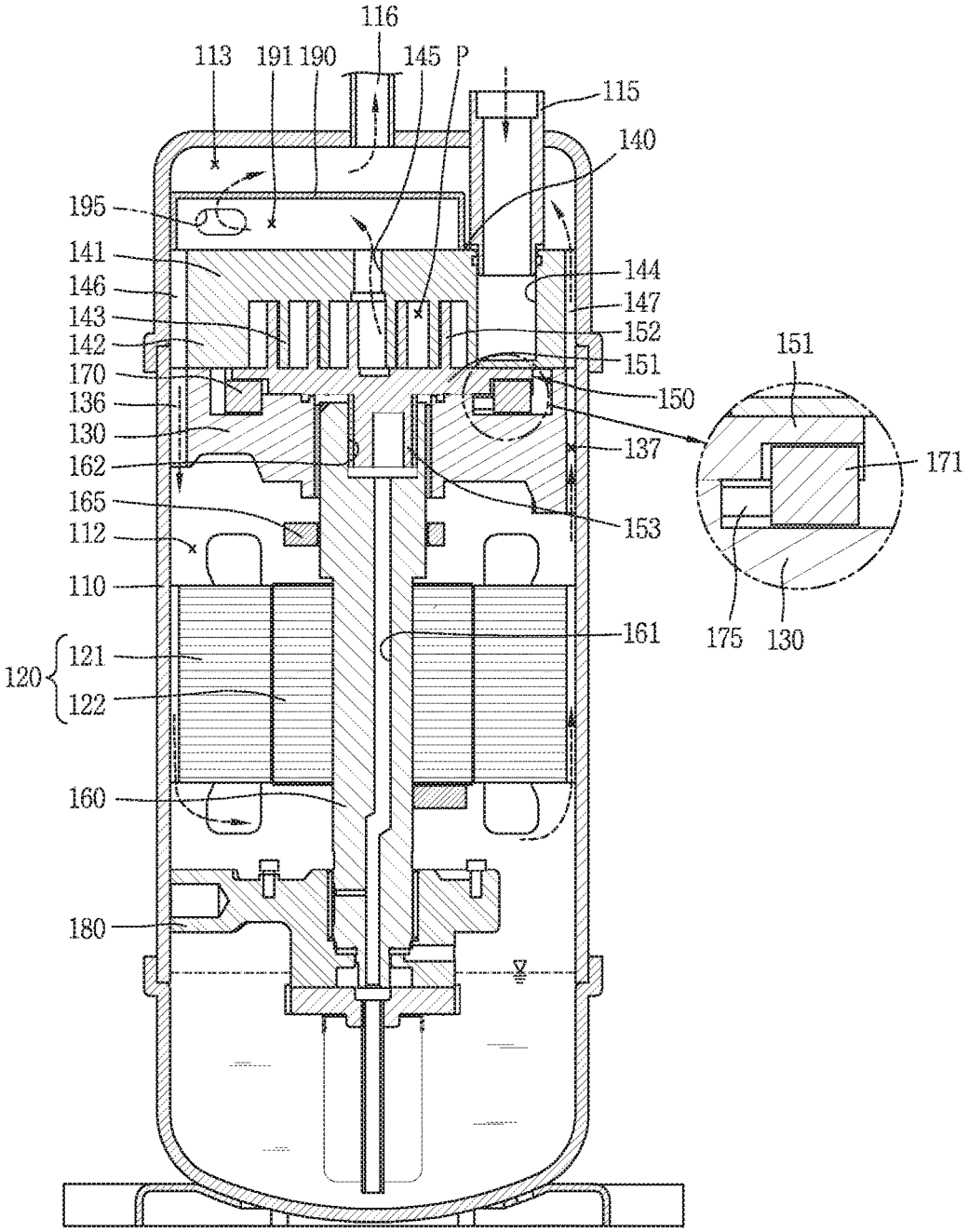
FIG. 2 is a longitudinal sectional view illustrating an example of a scroll compressor according to an embodiment.

FIG. 2 is a longitudinal sectional view illustrating an example of a scroll compressor according to an embodiment. As shown, in the scroll compressor according to this embodiment, a casing 110 may have a hermetic inner space. The inner space may be divided into a motor space 112, in which a drive motor 120, which is discussed hereinafter, is installed or provided, and an oil separation space 113 configured to separate oil from a refrigerant discharged from compression spaces, which are discussed hereinafter. However, the motor space 112 and the oil separation space 113 may communicate with each other by communication holes 146, 147 and communication grooves 136, 137, which are discussed hereinafter. Accordingly, one part or portion of a refrigerant discharged from compression spaces (P) to the oil separation space 113 may be discharged through a discharge pipe 116. On the other hand, another part or portion of the refrigerant may move to the motor space 112 from the compression spaces (P), then move to the oil separation space 113, and be discharged through the discharge pipe 116.

The drive motor 120 that generates a rotational force may be installed or provided at or in the motor space 112 of the casing 110, and a rotational shaft 160 having an oil passage 161 may be coupled to a rotor 122 of the drive motor 120. The rotational shaft 160 may be coupled to an orbiting scroll 150, which is discussed hereinafter, and transmit the rotational force of the drive motor 120 to the orbiting scroll 150. An unexplained reference numeral 121 denotes a stator. A main frame 130, configured to partition the motor space 112 and the oil separation space 113 from each other, and configured to support one end of the rotational shaft 160, may be fixedly-installed above the drive motor 120.

A fixed scroll 140, configured to partition the motor space 112 and the oil separation space 113 from each other together with the main frame 130, may be fixedly-installed on an upper surface of the main frame 130. Accordingly, the main frame 130 and the fixed scroll 140 may be fixedly-coupled to the casing 110 together. However, the fixed scroll 140 may be coupled to the casing 110 so as to slide up and down with respect to the main frame 130, but so as not to move in a circumferential direction.

The main frame 130 may be formed of a material having a high hardness, such as cast iron, for example. The fixed scroll 140 may be formed of a material lighter than the cast iron, for example, an aluminum material, like the orbiting scroll 150, which is discussed hereinafter. This may allow the fixed scroll 140 to have an enhanced processability, and may allow the scroll compressor to be light.

The fixed scroll 140 may include a plate portion or plate 141 of a disc shape, and a side wall portion or side wall 142 of a ring shape, which may be fixedly-coupled to an upper surface of the main frame 130, may be formed at a bottom edge of the plate portion 141. A fixed wrap 143, which forms the compression spaces (P) together with the orbiting scroll 150, may be formed within the side wall portion 142. A thrust surface, which forms a thrust bearing surface together with the plate portion 151 of the orbiting scroll 150, may be formed on a bottom surface of the side wall portion 142.

An inlet 144 that communicates with a suction chamber, which is discussed hereinafter, may be formed at one side of the plate portion 141 of the fixed scroll 140, and an outlet 145 that communicates with a discharge chamber, which is discussed hereinafter, may be formed at a middle part or portion of the plate portion 141. A first communication hole 146, configured to guide a refrigerant discharged through the outlet 145 to the motor space 112 of the casing 110 having the drive motor 120, may be formed at one side of an outer circumferential surface of the plate portion 141 of the fixed scroll 140. A second communication hole 147, configured to guide an oil-separated refrigerant inside of the motor space 112 to the oil separation space 113, may be formed to be spaced from the first communication hole 146 in a circumferential direction of the fixed scroll 140.

Communication grooves 136, 137 may be formed at the main frame 130 in correspondence to the communication holes 146, 147, such that a refrigerant or oil may move to the motor space 112 by communicating with the first and second communication holes 146, 147, and then the refrigerant may move to the oil separation space 113. With such a configuration, a part or portion of a refrigerant discharged from the compression spaces (P) to a space portion or space 191 of or within a discharge cover 190, which is discussed hereinafter, may move to the motor space 112 through the first communication hole 146 and the communication groove 136, thereby cooling the drive motor 120. Oil separated from the refrigerant while the drive motor 120 is cooled, may be collected to or in a bottom surface of the casing 110. On the other hand, the refrigerant may move to the oil separation space 113 through the communication groove 137 and the second communication hole 147, thereby being discharged to the outside through the discharge pipe 116 together with a refrigerant separated from oil in the oil separation space 113.

The orbiting scroll 150 may be coupled to the rotational shaft 160, and may orbit between the main frame 130 and the fixed scroll 140. An Oldham's ring 170 configured to restrict a rotation of the orbiting scroll 150 may be installed or provided between the main frame 130 and the orbiting scroll 150. An unexplained reference numeral 171 denotes a ring portion or ring of the Oldham's ring 170, and 175 denotes a key portion or key.

The orbiting scroll 150 may include a plate portion or plate 151 having a disc shape and supported at the main frame 130. An orbiting wrap 152, which forms the compression spaces (P) by being engaged with the fixed wrap 143, may be formed on an upper surface of the plate portion 151 of the orbiting scroll 150. A boss portion or boss 153, coupled to a boss insertion groove 162, may be formed on a bottom surface of the plate portion 151 of the orbiting scroll 150. With such a configuration, the orbiting scroll 150 may perform an orbiting motion by being engaged with the fixed scroll 140 in an eccentrically-coupled state to the rotational shaft 160. During this process, the two compression spaces (P) including a suction chamber, an intermediate pressure chamber, and a discharge chamber may be formed.

The orbiting scroll 150 may be formed of an aluminum material lighter than the main frame 130, like the fixed scroll 140. This may allow the scroll compressor to be lighter, and may miniaturize a balance weight 165 configured to attenuate an eccentric load by being coupled to the rotational shaft 160 or the rotor 122 as a centrifugal force generated when the orbiting scroll 150 rotates is reduced. Once the balance weight 165 is miniaturized, a length of the rotational shaft 160 may be reduced. This may allow the scroll compressor to be miniaturized, and a margin space inside of the casing 110 to be utilized as a length of the rotational shaft 160 may be reduced. That is, as the length of the rotational shaft 160 may be reduced, a length from the drive motor 120 to the fixed scroll 140 in a shaft direction or a direction in which the shaft extends lengthwise is reduced. As a result, a margin space may be generated in the casing 110, which may be utilized.

For instance, if the orbiting scroll 150 has a light weight, as discussed above, the scroll compressor may be driven at a high speed more than about 180 Hz, as an eccentric load due to a centrifugal force is reduced. However, if the scroll compressor is driven at a high speed, an oil leakage amount may be increased. This may cause lowering of reliability of the scroll compressor due to oil deficiency. Thus, in a scroll compressor which may be driven at a high speed, excessive leakage of oil should be prevented by increasing a volume of an oil separator. However, in a case in which the oil separator is installed or provided outside of the casing 110, when a length of the scroll compressor in a shaft or lengthwise direction is reduced, a length of the casing 110 in a shaft or lengthwise direction should be reduced and a length of the oil separator in a shaft or lengthwise direction should be increased. The reason is because an entire vibration noise of the scroll compressor may be increased as secondary vibrations of the oil separator are increased.

Considering this, the discharge cover 190 for oil separation may be installed or provided at or in the oil separation space 113 in a state in which a length of the casing 110 in the shaft direction is maintained, in order to remove the oil separator installed outside of the casing 110 without increasing a length of the casing 110 in the shaft direction. This may reduce vibration noise of the scroll compressor under the same efficiency.

Figure 3:
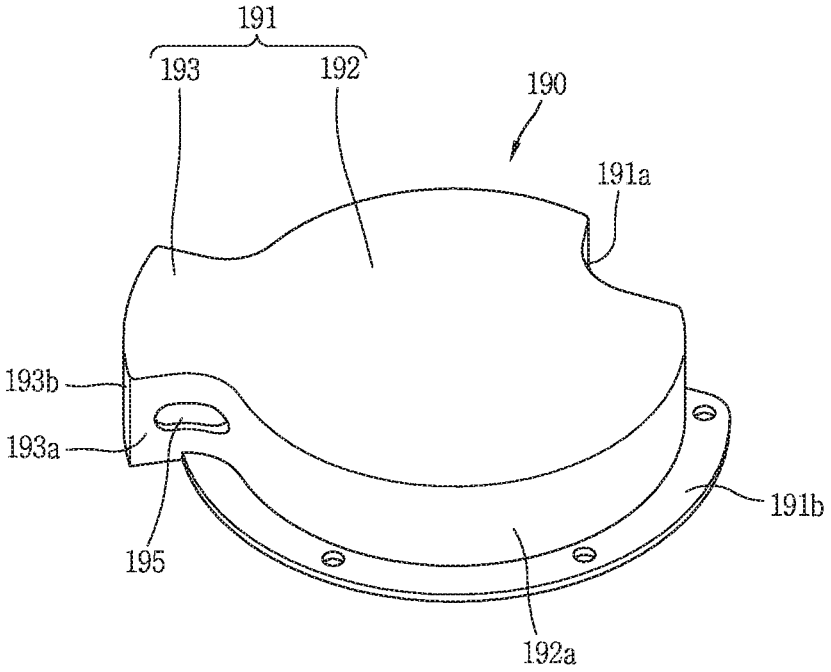
FIGS. 3 to 5 are a top view, a front view, and a bottom view of a discharge cover shown in FIG. 2, respectively.
Figure 4:
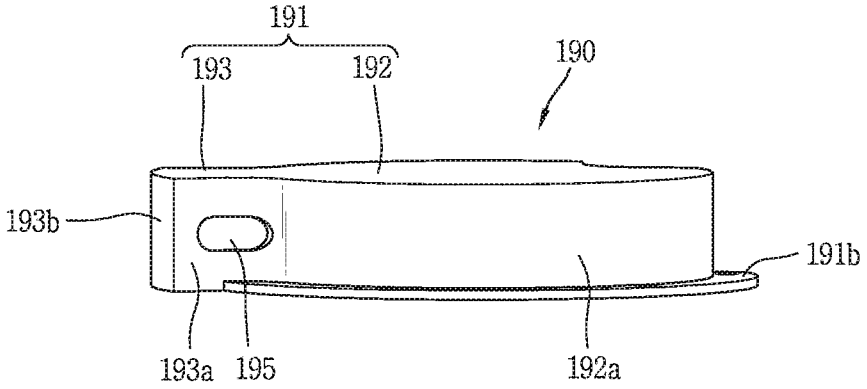
Figure 5:
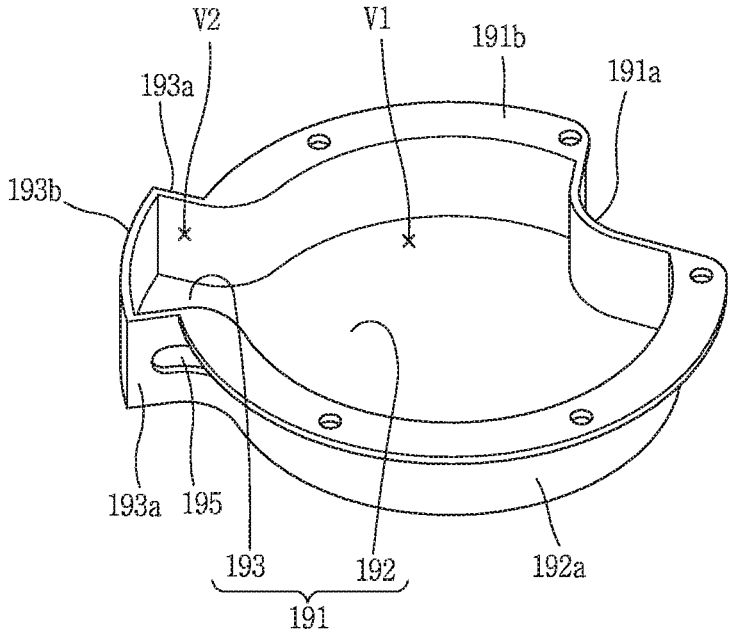
Figure 6:
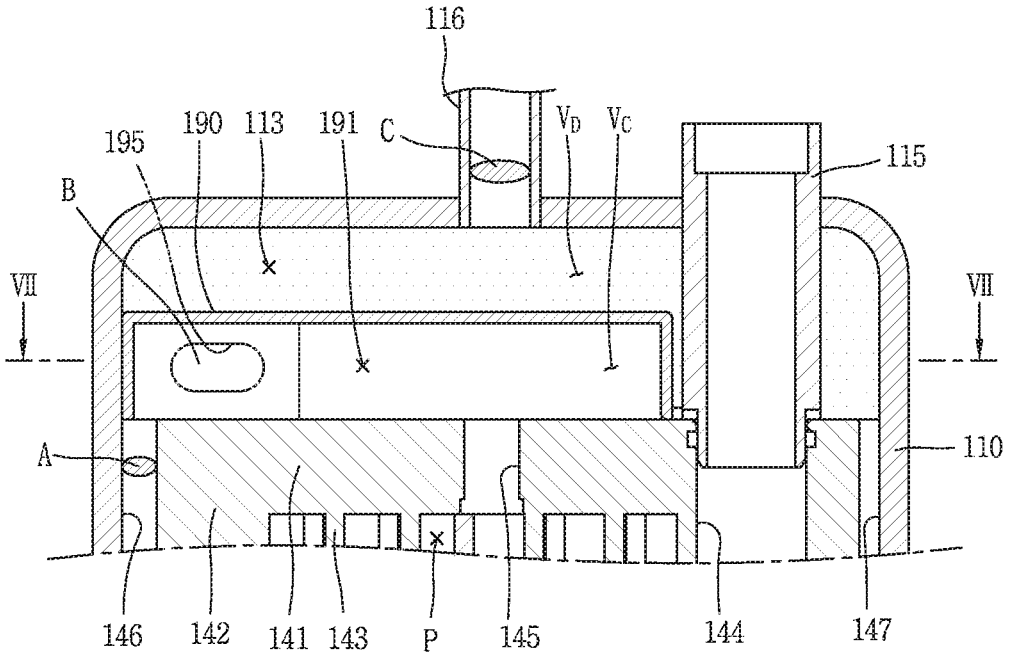
FIG. 6 is a longitudinal sectional view for explaining a size of a communication hole, a discharge hole, and a discharge pipe, an inner volume of a discharge cover, and a volume of an oil separation space, in a comparative manner, in a scroll compressor according to an embodiment.
Figure 7:
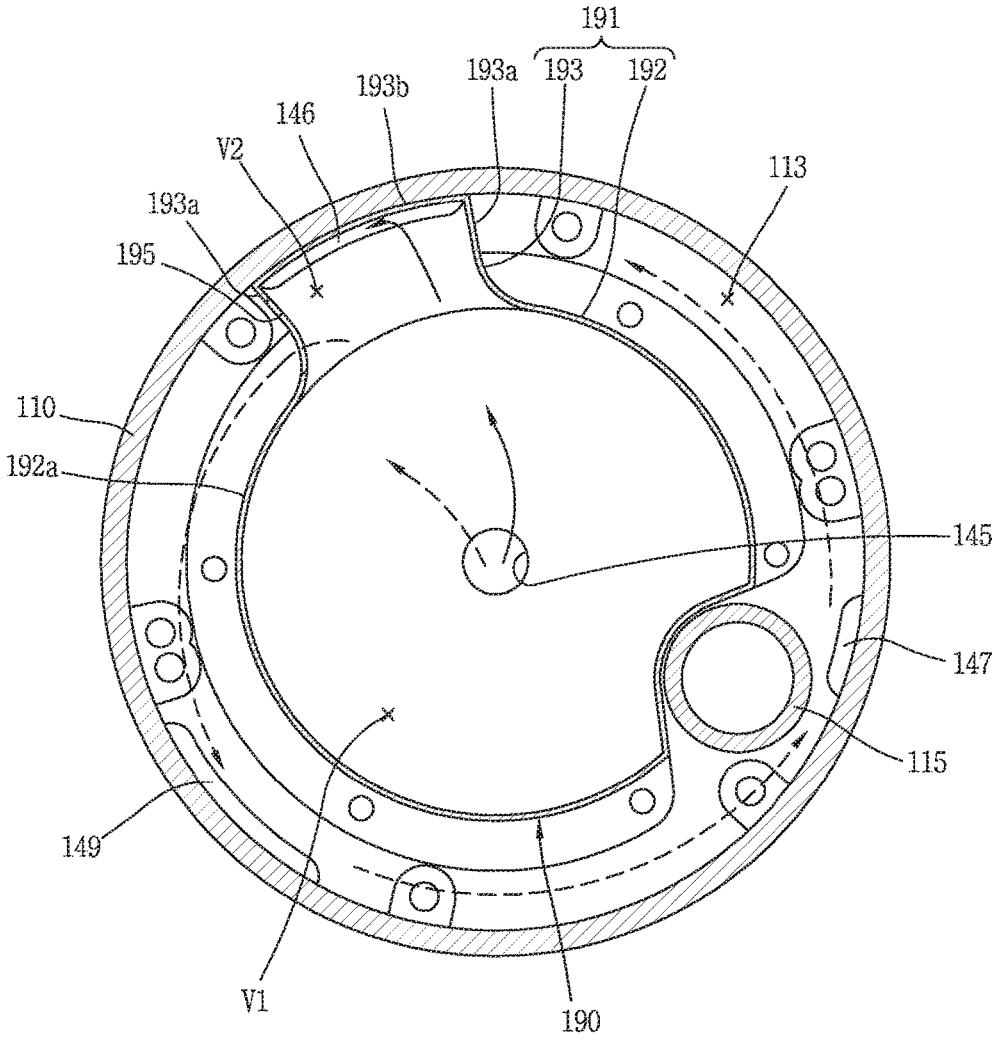
FIG. 7 is a sectional view taken along line "VII-VII" in FIG. 6.

FIGS. 3 to 5 are a top view, a front view, and a bottom view of a discharge cover shown in FIG. 2, respectively. FIG. 6 is a longitudinal sectional view for explaining a size of a communication hole, a discharge hole, and a discharge pipe, an inner volume of a discharge cover, and a volume of an oil separation space, in a comparative manner, in a scroll compressor according to an embodiment. FIG. 7 is a sectional view taken along line "VII-VII" in FIG. 6.

As shown, the discharge cover 190 has the space portion 191 which forms a discharge space, as its lower surface is open to accommodate a refrigerant discharged from the outlet 145 therein. A discharge hole 195, configured to guide a refrigerant discharged to the space portion 191 to the oil separation space 113, may be formed on a side surface of the space portion 191.

The space portion 191 may include a first space portion or space 192 configured to accommodate the outlet 145 therein, and a second space or space portion 193 that communicates with the first space portion 192 and configured to accommodate the first communication hole 146 therein. The second space portion 193 may be formed in plurality. For example, two side surfaces 193*a* of the second space portion 193 may be formed so as to be connected to two ends of an outer circumferential surface 192*a* of the first space portion 192. The two side surfaces 193*a* of the second space portion 193 may be referred to as a 'first surface'. One side surface 193*b* of the second space portion 193, disposed or provided between the two side surfaces 193*a*, may be referred to as a 'second surface'. The first surface and the outer circumferential surface 192*a* may be separated from an inner circumferential surface of the casing 110, whereas the second surface may contact the inner circumferential surface of the casing 110. With such a configuration, oil separation may be performed while a refrigerant circulates smoothly in the oil separation space 113. Unexplained reference numeral 191*a* denotes a suction pipe accommodation groove, and 191*b* denotes a cover coupling portion.

An inner volume (V1) of the first space portion 192 may be formed to be larger than an inner volume (V2) of the second space portion 193. This may increase a moving distance of a refrigerant from outside of the discharge cover 190, under the assumption that an area of the discharge cover 190 on a plane is the same. Further, this may allow a refrigerant and oil to be separated from each other more effectively.

An outer circumferential surface of the first space portion 192 may be spaced from the inner circumferential surface of the casing 110 by a predetermined distance, for formation of a circulation path along which oil may be separated from a refrigerant discharged to the outside of the discharge cover 190 while the refrigerant moves along the inner circumferential surface of the casing 110. In order to reduce a flow resistance of a refrigerant, the outer circumferential surface of the first space portion 192 may be formed to have a same curvature as the inner circumferential surface of the casing 110, at least partially.

An outer circumferential surface 193*b* of the second space portion 193 may closely contact the inner circumferential surface of the casing 110, such that the second space portion 193 forms a partition wall. In this case, the outer circumferential surface of the second space portion 193 may be open such that end portions of the two side surfaces 193*a* of the second space portion 193 may closely contact the inner circumferential surface of the casing 110. However, in the case in which the outer circumferential surface of the second space portion 193 is open, the end portions of the two side surfaces 193*a* of the second space portion 193 may be, for example, welded to the casing 110 or may be processed precisely, for separation of the second space portion 193 from the oil separation space 113. Accordingly, the outer circumferential surface 193*b* of the second space portion 193 may have a blocked shape not an open shape. This may reduce a discharge loss due to a flow resistance, as a refrigerant discharged to the outside of the discharge cover 190 through the discharge hole 195 moves in one direction along the circulation path.

For efficiency of the compressor, a sectional area (B) of the discharge hole 195 may be in proportion to a sectional area (A) of the first communication hole 146.

Figure 8:
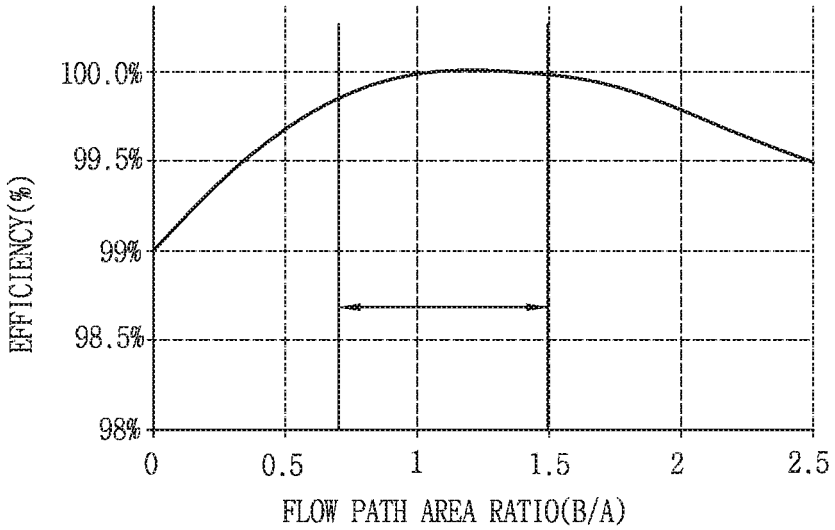
FIG. 8 is a graph showing efficiency of a scroll compressor according to a flow path area ratio (B/A)

FIG. 8 is a graph showing efficiency of the scroll compressor according to a flow path area ratio (B/A). As shown, efficiency of the scroll compressor is drastically lowered when a ratio between a sectional area (B) of the discharge hole and a sectional area (A) of the first communication hole (hereinafter, referred to as an "area ratio (B/A)") is lower than about 0.75 or higher than about 1.5. More specifically, if the discharge hole 195 is much smaller than the first communication hole 146, cooling efficiency of the drive motor 120 is lowered, lowering efficiency of the scroll compressor. On the other hand, if the discharge hole 195 is much larger than the first communication hole 146, a large amount of refrigerant discharged from the compression spaces (P) moves to the motor space 113. This may cause a discharge path of a large amount of refrigerant among an entire refrigerant to become long, and may cause a discharge loss. As a result, efficiency of the scroll compressor may be lowered. Accordingly, the ratio (B/A) between the sectional area (B) of the discharge hole and the sectional area (A) of the first communication hole may be within a range of about 0.7~1.5.

A refrigerant discharge amount of the scroll compressor may be determined based on a compression volume and a driving speed. The refrigerant discharge amount may be influenced by a discharge area. That is, a total sectional area (A+B) between the sectional area (A) of the first communication hole 146 and the sectional area (B) of the discharge hole 195, may be formed to be smaller than or equal to a sectional area (C) of a flow path inside of the discharge pipe 116. If the sectional area (C) of the flow path inside of the discharge pipe 116 is smaller than the total sectional area (A+B), a refrigerant may remain in the oil separation space 113 without being circulated. This may also cause a discharge loss.

The discharge pipe 116 may be coupled to the discharge hole 195, such that its shaft direction or a direction in which it extends lengthwise is perpendicular to a shaft direction or a direction in which it extends lengthwise of the discharge hole 195. This may enhance oil separation efficiency, as a moving distance of a refrigerant discharged through the discharge hole 195 may be increased.

Further, a volume ($V_D$) of the oil separation space 113 may be formed to be equal to or larger than a volume ($V_C$) of the space portion 191 of the discharge cover 190. If the volume ($V_C$) of the space portion 191 of the discharge cover 190 is larger than the volume ($V_D$) of the oil separation space 113, the space portion 191 of the discharge cover 190 has a dead volume. This may cause a compression loss, and may reduce the oil separation space 113, as the volume ($V_D$) of the oil separation space 113 is relatively reduced.

Figure 9:
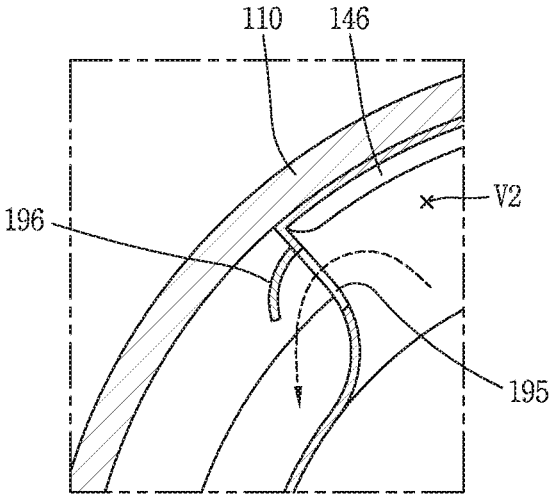
FIGS. 9 and 10 are horizontal sectional view illustrating embodiments of a guide provided at a discharge hole.
Figure 10:
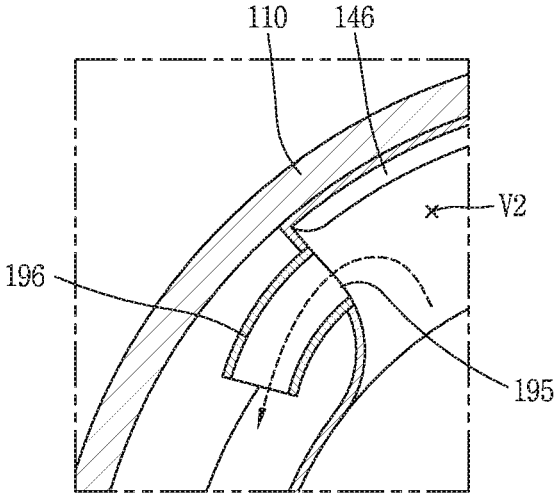

A guide 196, configured to guide a refrigerant and oil in a circumferential direction, may be formed on or at an outer side surface of the discharge hole 195. As shown in FIG. 9, the guide 196 may be formed to have a cut-hemispherical shape. Alternatively, as shown in FIG. 10, the guide 196 may be formed to have a bent pipe shape. With such a configuration, a refrigerant discharged to the oil separation space 113 through the discharge hole 195 may flow in a curved line shape by the guide 196, thereby circulating in a circumferential direction along the inner circumferential surface of the casing 110. This may reduce a discharge resistance, and may allow a refrigerant to move at a high speed. As a result, an oil separation performance may be enhanced.

As discussed above, in a case in which the orbiting scroll 150 is formed of a light material, such as aluminum, an eccentric load of the rotational shaft 160 to which the orbiting scroll 150 has been coupled may be significantly reduced. Especially, as shown in FIG. 2, in a case in which the boss portion 153 of the orbiting scroll 150 is inserted into the rotational shaft 160 as the boss insertion groove 162 is formed at an upper end of the rotational shaft 160, a supporting point of the main frame 130 and an operation point of the orbiting scroll 150 are almost the same. This may significantly reduce an eccentric load of the rotational shaft 160.

With such a configuration, the scroll compressor may be driven at a high speed more than about 180 Hz, and a length of the scroll compressor in the shaft direction may be reduced, as a space occupied by the balance weight 165 may be reduced due to a decrease of an eccentric load. However, in this embodiment, the discharge cover 190 for oil separation may be installed at the oil separation space 113 serving as a margin space inside of the casing 110, the margin space occurring as a length of the scroll compressor in the shaft direction is reduced. This may reduce an installation space of the compressor more than in a case in which the oil separator is installed outside of the casing, and may attenuate vibration noise.

Further, the discharge cover 190 may be provided with the discharge hole 195 through which oil may be centrifugally separated from a refrigerant. In this case, the discharge hole 195 may be formed to have a proper sectional surface when compared with the communication hole 146 through which a part or portion of a refrigerant moves in order to cool the drive motor 120, thereby minimizing a discharge loss of a refrigerant and obtaining a sufficient oil separation space.

Furthermore, a sectional area of the discharge pipe 116 may be formed so as not to be smaller than the total sectional area (A+B) between the sectional area (A) of the first communication hole 146 and the sectional area (B) of the discharge hole 195, thereby preventing a discharge loss. Also, as the volume ($V_D$) of the discharge cover 190 is formed not to be larger than the volume ($V_D$) of the oil separation space, a compression loss may be prevented and an oil separation effect may be enhanced.

Embodiments disclosed herein provide a scroll compressor capable of optimizing a size of an oil separator in a state in which the oil separator is installed in a casing of the scroll compressor. Embodiments disclosed herein further provide a scroll compressor capable of effectively separating oil from a refrigerant by an oil separator installed at an inner space of a casing. Embodiments disclosed herein further provide a scroll compressor capable of being driven at a high speed, through an optimized relation between an oil separator installed at an inner space of a casing, and other members.

Embodiments disclosed herein provide a scroll compressor that may include a casing having a hermetic inner space; a drive motor installed or provided at the inner space of the casing, and configured to generate a rotational force; a rotational shaft which rotates by being coupled to a rotor of the drive motor; an orbiting scroll which performs an orbital motion by being coupled to the rotational shaft; a fixed scroll which forms a compression space having a suction chamber, an intermediate pressure chamber, and a discharge chamber, by being coupled to the orbiting scroll; and a discharge cover installed or provided at or in the inner space of the casing, having a space portion or space communicated with the discharge chamber by being separated from the inner space of the casing, and having one or more discharge holes on a side surface of the space portion corresponding to an inner wall surface of the casing, among surfaces of the space portion, the discharge hole for communicating an inside and an outside of the space portion with each other. A communication hole configured to communicate the inside of the space portion of the discharge cover with the inner space of the casing where the drive motor is installed, may be formed at the fixed scroll. A ratio (B/A) between a sectional area (B) of the discharge hole and a sectional area (A) of the communication hole may be within a range of about 0.7~1.5.

In an assumption that a space formed among an outer side surface of the discharge cover, one side surface of the fixed scroll, and an inner wall surface of the casing is an oil separation space, a discharge pipe may be penetratingly-coupled to the casing so as to be communicated with the oil separation space. A sectional area (C) of a flow path inside of the discharge pipe may be formed to be equal to or larger than a total sectional area (A+B) between the sectional area (A) of the communication hole and the sectional area (B) of the discharge hole.

The discharge pipe may be coupled to the discharge hole such that its shaft direction or a direction in which it extends lengthwise may be perpendicular to a shaft direction or a direction in which it extends lengthwise of the discharge hole. In an assumption that a space formed among an outer side surface of the discharge cover, one side surface of the fixed scroll, and an inner wall surface of the casing is an oil separation space, a volume ($V_D$) of the space portion of the discharge cover may be formed to be equal to or smaller than a volume ($V_D$) of the oil separation space.

An outer circumferential surface of the discharge cover may include first surfaces spaced from an inner circumferential surface of the casing, and a second surface formed between two ends of the first surfaces, and contacting the inner circumferential surface of the casing. The discharge hole may be formed on one of the first surfaces on the basis of the second surface.

The space portion of the discharge cover may include a first space portion or space configured to accommodate therein an outlet through which a refrigerant inside the discharge chamber may be discharged, and having an outer circumferential surface spaced from an inner wall surface of the casing by a predetermined gap; and a second space portion or space communicated with the first space portion, configured to accommodate the communication hole therein, and having an outer circumferential surface contacting the inner wall surface of the casing. The discharge hole may be formed such that at least a part or portion thereof may be included in the second space portion. A volume of the first space portion may be formed to be larger than a volume of the second space portion.

A guide configured to guide a refrigerant and oil in a circumferential direction may be formed on an outer side surface of the discharge hole.

A frame, configured to support the rotational shaft in a radial direction and to support the orbiting scroll in a shaft direction or a direction in which it extends lengthwise, may be coupled to the casing. The orbiting scroll may be formed of a material lighter than the frame per unitary area.

Embodiments disclosed herein provide a scroll compressor that may include a casing having a hermetic inner space; a drive motor installed or provided at the inner space of the casing, and configured to generate a rotational force; a rotational shaft which rotates by being coupled to a rotor of the drive motor; an orbiting scroll which performs an orbital motion by being coupled to the rotation shaft; a fixed scroll which forms a compression space having a suction chamber, an intermediate pressure chamber, and a discharge chamber, by being coupled to the orbiting scroll; and a discharge cover installed or provided at the inner space of the casing, and having a space portion or space communicated with the discharge chamber by being separated from the inner space of the casing, the space portion communicated with a motor space and an oil separation space, respectively. An outlet for communicating the discharge chamber with the oil separation space of the casing may be formed at the fixed scroll, and a plurality of communication holes for communicating the oil separation space with the motor space may be formed at one side of the outlet.

The discharge cover may be fixed to one side surface of the fixed scroll, such that the space portion may accommodate therein the outlet and at least one of the communication holes for communication with each other. A discharge hole may be formed at the discharge cover, such that the space portion of the discharge cover may be communicated with the oil separation space of the casing.

A sectional area of the discharge hole may be formed to be larger than a sectional area of the communication hole accommodated in the discharge cover. A ratio (B/A) between a sectional area (B) of the discharge hole and a sectional area (A) of the communication hole may be within a range of about 0.7~1.5.

A discharge pipe may be communicated with the oil separation space, and a sectional area (C) of a flow path inside of the discharge pipe may be formed to be equal to or larger than a total sectional area (A+B) between the sectional area (A) of the communication hole and the sectional area (B) of the discharge hole. The discharge pipe may be coupled to the discharge hole such that its shaft direction or a direction in which it extends lengthwise may be perpendicular to a shaft direction or a direction in which it extends lengthwise of the discharge hole.

Embodiments disclosed herein provide a scroll compressor that may include a compression space having a suction chamber, an intermediate pressure chamber, and a discharge chamber, as a fixed scroll and an orbiting scroll are engaged with each other at an inner space of a casing; a discharge space communicated with the compression space, and formed at a space portion of a discharge cover provided at the fixed scroll; a motor space having a drive motor installed or provided at or in the inner space of the casing so as to transmit a rotational force to the orbiting scroll, and communicated with the discharge space through a first communication hole provided at the fixed scroll; and an oil separation space which forms an external space of the discharge cover, formed between an upper surface of the fixed scroll and an inner side surface of the casing, communicated with the discharge space through a discharge hole provided at the discharge cover, and communicated with a discharge pipe. A ratio between an area of a flow path for communicating the discharge space with the oil separation space, and an area of a flow path for communicating the discharge space with the motor space may be within a range of about 0.7~1.5. An area of the discharge pipe may be formed to be equal to or larger than a total area between the area of the flow path for communicating the discharge space with the motor space, and the area of the flow path for communicating the discharge space with the oil separation space.

A scroll compressor according to embodiments disclosed herein may have at least the following advantages.

First, as the discharge cover for guiding a refrigerant discharged from the compression space to the motor space and the oil separation space may be installed or provided at the inner space of the casing, oil separation may be performed at the inner space of the casing. This may reduce vibration noise of the scroll compressor more than in a case in which the oil separator is installed outside of the casing.

Second, as a ratio between an area of a flow path for guiding a refrigerant discharged to the discharge cover to the oil separation space, and an area of a flow path for guiding the refrigerant to the motor space is optimized, a discharge loss may be reduced. This may enhance efficiency of the scroll compressor.

Third, a sectional area of the discharge pipe may be optimized with respect to a total area between the area of the flow path for guiding the refrigerant to the motor space, and the area of the flow path for guiding the refrigerant to the oil separation space. This may reduce a discharge loss, and may enhance efficiency of the scroll compressor.

Further, a ratio between a volume of the discharge cover and a volume of the oil separation space may be optimized. This may reduce a discharge loss, and may enhance efficiency of the compressor.

Further scope of applicability of the embodiments will become more apparent from the detailed description given. However, it should be understood that the detailed description and specific examples, while indicating embodiments, are given by way of illustration only, since various changes and modifications within the spirit and scope will become apparent to those skilled in the art from the detailed description.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing having an inner space;

a drive motor provided at the inner space of the casing, and configured to generate a rotational force;

a rotational shaft rotated by the drive motor;

an orbiting scroll that performs an orbital motion by being coupled to the rotational shaft;

a fixed scroll that forms a compression space by being coupled to the orbiting scroll; and a discharge cover provided at the inner space of the casing, the discharge cover having a space that communicates with the compression space while being separated from the inner space of the casing, and having one or more discharge hole at a side surface thereof, the one or more discharge holes providing communication between an inside and an outside of the space, wherein an outer circumferential surface of the discharge cover includes:

first surfaces spaced from an inner circumferential surface of the casing; and a second surface formed between two ends of the first surfaces, the second surface contacting the inner circumferential surface of the casing, wherein the one or more discharge hole is formed on one of the first surfaces, wherein a communication hole, configured to communicate the inside of the space of the discharge cover with the inner space of the easing at which the drive motor is provided, is formed at the fixed scroll, and wherein a ratio (B/A) between a summation of a total sectional area (B) of the one or more discharge hole and a sectional area (A) of the communication hole is within a range of 1.0~1.5.

2. The scroll compressor of claim 1, wherein a space formed by an outer side surface of the discharge cover, one side surface of the fixed scroll, and an inner wall surface of the casing is an oil separation space, a discharge pipe is penetratingly-coupled to the casing so as to communicate with the oil separation space, and wherein a sectional area (C) of a flow path inside of the discharge pipe is formed to be equal to or larger than a total sectional area (A+B) of the sectional area (A) of the communication hole and the total sectional area (B) of the one or more discharge hole.

3. The scroll compressor of claim 1, wherein a discharge pipe is coupled to the one or more discharge hole such that a central longitudinal axis of the discharge pipe extends perpendicular to a central longitudinal axis of the one or more discharge hole.

4. The scroll compressor of claim 1, wherein a space formed by an outer side surface of the discharge cover, one side surface of the fixed scroll, and an inner wall surface of the casing is an oil separation space, and a volume of the space of the discharge cover is formed to be equal to or smaller than a volume of the oil separation space.

5. The scroll compressor of claim 1, wherein the space of the discharge cover includes:

a first space configured to accommodate therein an outlet through which a refrigerant inside of the discharge chamber is discharged, and having an outer circumferential surface spaced from the inner circumferential surface of the casing by a predetermined gap; and a second space that communicates with the first space, configured to accommodate the communication hole therein, and having an outer circumferential surface that contacts the inner circumferential surface of the casing, and wherein the one or more discharge hole is formed such that at least a portion thereof is included in the second space.

6. The scroll compressor of claim 5, wherein a volume of the first space is larger than a volume of the second space.

7. The scroll compressor of claim 1, further including a guide configured to guide a refrigerant and oil formed at an outer side surface of the one or more discharge hole.

8. The scroll compressor of claim 7, wherein the guide extends from the outer side surface of the one or more discharge hole, so as to guide the refrigerant and oil in a circumferential direction.

9. The scroll compressor of claim 1, further including a frame, configured to support the rotational shaft in a radial direction and to support the orbiting scroll in a central longitudinal direction, is coupled to the casing, and wherein the orbiting scroll is formed of a material lighter than the frame per unit area.

10. A scroll compressor, comprising:

a casing having an inner space;

a drive motor provided at the inner space of the casing, and configured to generate a rotational force;

a rotational shaft rotated by the drive motor;

an orbiting scroll that performs an orbital motion by being coupled to the rotational shaft;

a fixed scroll that forms a compression space by being coupled to the orbiting scroll;

a discharge cover provided at the inner space of the casing, and having a space that communicates with the compression space while being separated from the inner space of the casing, wherein the space communicates with a motor space and an oil separation space, respectively;

one of more discharge hole provided at a side surface of the discharge cover; and a discharge pipe is provided that communicates with the oil separation space, wherein the discharge pipe communicates the one or more discharge hole such that a central longitudinal axis of the discharge pipe is substantially perpendicular to a central longitudinal axis of the one or more discharge hole, wherein an outlet that provides communication between the compression space and the oil separation space of the casing is formed a the fixed scroll, wherein a plurality of communication holes that communicates the oil separation space with the motor space is formed at one side of the outlet, wherein the discharge cover is fixed to one side surface of the fixed scroll, such that the discharge cover accommodates therein the outlet and least one of the communication holes for communication between the space of the discharge cover and the outlet and at least one of the communication hole is formed at the discharge cover such that the space of the discharge cover communicates with the oil separation space of the casing, and wherein a summation of a total section area of the one or more discharge hole is larger than a sectional area of the at least one of the communication holes accommodated in the discharge cover.

11. The scroll compressor of claim 10, wherein a ratio (B/A) between the summation of the total sectional area (B) of the one or more discharge hole and a sectional area (A) of the at least one of the communication holes is within a range of 1.0~1.5.

12. The scroll compressor of claim 11, wherein a sectional area (C) of a flow path inside of the discharge pipe is equal to or larger than a total sectional area (A+B) between the sectional area (A) of the at least one of the communication holes and the total sectional area (B) of the one or inure discharge hole.

13. A scroll compressor, comprising:

a compression space formed by a fixed scroll and an orbiting scroll engaged with each other at an inner space of a casing;

a discharge space that communicates with the compression space and formed by a discharge cover provided at the fixed scroll;

a motor space having a drive motor provided at the inner space of the casing so as to transmit a rotational force to the orbiting scroll, the motor space communicating with the discharge space through a first communication hole provided at the fixed scroll; and an oil separation space formed by the discharge cover, an upper surface of the fixed scroll, and an inner side surface of the casing, the oil separation space communicating with the discharge space through one or more discharge hole provided at the discharge cover and with a discharge pipe, wherein an outer circumferential surface of the discharge cover includes:

first surfaces spaced from an inner circumferential surface of the casing; and a second surface formed between two ends of the first surfaces, the second surface contacting the inner circumferential surface of the casing, wherein the one or more discharge hole is formed on one of the first surfaces, wherein a communication hole, configured to communicate the inside of the space of the discharge cover with the inner space of the casing at which the drive motor is provided, is formed at the fixed scroll, and wherein a ratio (B/A) between a summation of a total sectional area (B) of the one or more discharge hole and a sectional area (A) of the communication hole is within a range of 1.0~1.5.

14. The scroll compressor of claim 13, wherein an area of the discharge pipe is formed to be equal to or larger than a total area between an area of a flow path for communication of the discharge space with the motor space, and an area of a flow path for communication of the discharge space with the oil separation space.

* * * * *